US010301801B2

(12) United States Patent
Sawaski

(10) Patent No.: US 10,301,801 B2
(45) Date of Patent: May 28, 2019

(54) FAUCET INCLUDING CAPACITIVE SENSORS FOR HANDS FREE FLUID FLOW CONTROL

(71) Applicant: Delta Faucet Company, Indianapolis, IN (US)

(72) Inventor: Joel D. Sawaski, Indianapolis, IN (US)

(73) Assignee: Delta Faucet Company, Indianapolis, IN (US)

( * ) Notice: Subject to any disclaimer, the term of this patent is extended or adjusted under 35 U.S.C. 154(b) by 0 days.

(21) Appl. No.: 15/645,966

(22) Filed: Jul. 10, 2017

(65) Prior Publication Data

US 2017/0306596 A1 Oct. 26, 2017

Related U.S. Application Data

(63) Continuation-in-part of application No. 14/575,925, filed on Dec. 18, 2014, now Pat. No. 9,702,128.

(51) Int. Cl.

| | |
|---|---|
| ***E03C 1/05*** | (2006.01) |
| ***E03C 1/04*** | (2006.01) |
| ***E03C 1/02*** | (2006.01) |

(52) U.S. Cl.

CPC ..... *E03C 1/057* (2013.01); *E03C 1/0404* (2013.01); *E03C 1/0412* (2013.01); *E03C 2001/026* (2013.01)

(58) Field of Classification Search

CPC ..... E03C 1/04; E03C 1/0404; E03C 1/0412; E03C 1/057; E03C 2001/026

See application file for complete search history.

(56) References Cited

U.S. PATENT DOCUMENTS

| | | | |
|---|---|---|---|
| 3,505,692 | A | 4/1970 | Forbes |
| 4,716,605 | A | 1/1988 | Shepherd et al. |
| 4,823,414 | A | 4/1989 | Piersimoni et al. |

(Continued)

FOREIGN PATENT DOCUMENTS

| | | |
|---|---|---|
| WO | WO 2007/082301 | 7/2007 |
| WO | WO 2008/094651 | 8/2008 |

(Continued)

OTHER PUBLICATIONS

Leonardo Bonanni et al.; "Context-Aware Work Surfaces"; MIT Media Laboratory; Sep. 21, 2004.

*Primary Examiner* — Marina A Tietjen
(74) *Attorney, Agent, or Firm* — Faegre Baker Daniels LLP

(57) ABSTRACT

A faucet comprises a spout, a passageway that conducts water flow through the spout, and an electrically operable valve disposed within the passageway. A first capacitive sensor has a first detection field that generates a first output signal upon detection of a user's hands in the first detection field, and a second capacitive sensor has a second detection field that generates a second output signal upon detection of a user's hands in the second detection field. A controller is coupled to the first and second capacitive sensors and the electrically operable valve. The controller is programmed to actuate the electrically operable valve in response to detecting the user's hands in the first detection field and not in the second detection field for a predetermined period of time surrounding the detection of the user's hands in the first detection field.

21 Claims, 8 Drawing Sheets

(56) References Cited

U.S. PATENT DOCUMENTS 5,549,273 A * 8/1996 Aharon ..... E03C 1/057 251/129.04
5,670,945 A 9/1997 Applonie
5,694,653 A 12/1997 Harald
6,250,601 B1 6/2001 Kolar et al.
6,452,514 B1 9/2002 Philipp
6,962,168 B2 11/2005 McDaniel et al.
6,968,860 B1 11/2005 Haenlein et al.
7,083,156 B2 8/2006 Jost et al.
7,104,519 B2 9/2006 O'Maley et al.
7,150,293 B2 12/2006 Jonte
7,232,111 B2 6/2007 McDaniel et al.
7,458,520 B2 12/2008 Belz et al.
7,537,023 B2 5/2009 Marty et al.
7,537,195 B2 5/2009 McDaniel et al.
7,631,372 B2 12/2009 Marty et al.
7,690,395 B2 4/2010 Jonte et al.
7,743,782 B2 6/2010 Jost
7,806,141 B2 10/2010 Marty et al.
7,942,013 B2 5/2011 Kim
7,997,301 B2 8/2011 Marty et al.
8,028,355 B2 10/2011 Reeder et al.
8,127,782 B2 3/2012 Jonte et al.
8,162,236 B2 4/2012 Rodenbeck et al.
8,171,578 B2 5/2012 Tsujita et al.
8,376,313 B2 2/2013 Burke et al.
8,381,329 B2 2/2013 Bayley et al.
8,407,827 B1 4/2013 Friedman et al.
8,418,993 B2 4/2013 Chen
8,424,569 B2 4/2013 Marty et al.
8,438,672 B2 5/2013 Reeder et al.
8,469,056 B2 6/2013 Marty et al.
8,528,579 B2 9/2013 Jonte et al.
8,561,626 B2 10/2013 Sawaski et al.
8,572,772 B2 11/2013 Wolf et al.
8,613,419 B2 12/2013 Rodenbeck et al.
8,776,817 B2 7/2014 Sawaski et al.
8,823,642 B2 9/2014 Valik et al.
8,827,239 B2 9/2014 Chen
8,827,240 B2 9/2014 Chen
8,844,564 B2 9/2014 Jonte et al.
8,939,429 B2 1/2015 Sawaski et al.
8,944,105 B2 2/2015 Rodenbeck et al.
8,950,730 B2 2/2015 Bedolla et al.
8,962,168 B2 2/2015 Suga
8,973,612 B2 3/2015 Sawaski et al.
8,976,136 B2 3/2015 Annett et al.
8,997,270 B2 4/2015 Murata et al.
9,032,565 B2 5/2015 Loeck et al.
9,057,182 B1 6/2015 Friedman et al.
9,057,183 B2 6/2015 Chen
9,062,790 B2 6/2015 Esche et al.
9,074,698 B2 7/2015 Esche et al.
9,187,884 B2 11/2015 Belz et al.
9,243,390 B2 1/2016 Rosko et al.
9,347,207 B2 5/2016 Chen
9,551,137 B2 1/2017 Chen
9,624,655 B2 4/2017 Gregory et al.
9,655,172 B2 5/2017 Sumi et al.
9,677,255 B2 6/2017 Shirai et al.
9,695,579 B2 7/2017 Herbert et al.
9,695,580 B2 7/2017 Esche et al.
9,702,128 B2 7/2017 Sawaski
2004/0025248 A1* 2/2004 Lang ..... E03C 1/05 4/623
2005/0199841 A1 9/2005 O'Maley
2007/0057215 A1* 3/2007 Parsons ..... E03C 1/05 251/129.04
2007/0170384 A1* 7/2007 Goodman ..... E03C 1/057 251/129.04
2009/0056011 A1* 3/2009 Wolf ..... E03C 1/057 4/623
2010/0089472 A1 4/2010 Meza
2010/0108165 A1 5/2010 Rodenbeck et al.
2010/0170570 A1 7/2010 Rodenbeck et al.
2012/0017367 A1 1/2012 Reeder
2012/0055557 A1 3/2012 Belz et al.
2012/0227849 A1 9/2012 Rodenbeck et al.
2013/0100033 A1 4/2013 Yuan et al.
2013/0146160 A1 6/2013 Davidson et al.
2013/0186196 A1 7/2013 Veros et al.
2013/0276911 A1 10/2013 Meehan et al.
2014/0000733 A1 1/2014 Jonte et al.
2014/0015595 A1 1/2014 Van Ausdall et al.
2014/0109984 A1 4/2014 Rodenbeck et al.
2014/0261750 A1 9/2014 Rosko et al.
2014/0326321 A1 11/2014 Sawaski et al.
2014/0352799 A1 12/2014 Rosko et al.
2014/0359935 A1 12/2014 Veros et al.
2014/0366264 A1 12/2014 Ciavarella et al.
2015/0013064 A1 1/2015 Marty et al.
2015/0074893 A1 3/2015 Veros et al.
2015/0233100 A1 8/2015 Loeck et al.
2015/0308084 A1 10/2015 Thompson et al.
2016/0024766 A1 1/2016 Sawaski et al.
2016/0024767 A1 1/2016 Hong et al.
2016/0117022 A1 4/2016 Kim et al.
2016/0208465 A1 7/2016 Evans et al.
2016/0208467 A1 7/2016 Song
2016/0208945 A1 7/2016 Lance et al.
2016/0208946 A1 7/2016 Moghe et al.
2016/0208947 A1 7/2016 Song et al.
2016/0208948 A1 7/2016 Wallerstorfer
2016/0208949 A1 7/2016 Wallerstorfer
2016/0235239 A1 8/2016 Patadia
2016/0340879 A1 11/2016 Chen
2017/0003253 A1 1/2017 Kaneko
2017/0051481 A1 2/2017 Mercer
2017/0059050 A1 3/2017 Chiu et al.
2017/0068228 A1 3/2017 Schoenbeck et al.
2017/0081832 A1 3/2017 Mielke et al.
2017/0212599 A1 7/2017 Sharma
2017/0256974 A1 9/2017 Baker
2017/0292253 A1 10/2017 Chen

FOREIGN PATENT DOCUMENTS

WO WO 2008/118402 10/2008
WO WO 2009/075858 6/2009
WO WO 2011/133665 10/2011
WO WO 2013/086206 6/2013
WO WO 2013/086217 6/2013
WO WO 2014/150123 9/2014
WO WO 2016/118528 A1 7/2016
WO WO 2016/118529 A2 7/2016

* cited by examiner

FAUCET INCLUDING CAPACITIVE SENSORS FOR HANDS FREE FLUID FLOW CONTROL

CROSS REFERENCE TO RELATED APPLICATION

This application is a continuation-in-part of U.S. patent application Ser. No. 14/575,925, filed Dec. 18, 2014, the disclosure of which is expressly incorporated by reference herein.

BACKGROUND AND SUMMARY

The present disclosure relates generally to improvements in capacitive sensors for activation of faucets. More particularly, the present invention relates to the placement of a capacitive sensors in or adjacent to faucet spouts and/or faucet handles to sense proximity of a user of the faucet and then control the faucet based on output signals from the capacitive sensors.

Electronic faucets are often used to control fluid flow. Electronic faucets may include proximity sensors such as active infrared ("IR") proximity detectors or capacitive proximity sensors. Such proximity sensors are used to detect a user's hands positioned near the faucet, and turn the water on and off in response to detection of the user's hands. Other electronic faucets may use touch sensors to control the faucet. Such touch sensors include capacitive touch sensors or other types of touch sensors located on a spout of the faucet or on a handle for controlling the faucet. Capacitive sensors on the faucet may also be used to detect both touching of faucet components and proximity of the user's hands adjacent the faucet.

In one illustrated embodiment of the present disclosure, a faucet comprising: a spout; a passageway that conducts water flow through the spout; an electrically operable valve disposed within the passageway and having an opened position, in which water is free to flow through the passageway, and a closed position, in which the passageway is blocked; a first capacitive sensor having a first detection field that generates a first output signal upon detection of a user's hands in the first detection field; a second capacitive sensor having a second detection field that generates a second output signal upon detection of a user's hands in the second detection field; and a controller coupled to the first and second capacitive sensors and the electrically operable valve, the controller being programmed to actuate the electrically operable valve in response to detecting the user's hands in the first detection field but not in the second detection field.

In another illustrated embodiment of the present disclosure, a method of actuating a faucet comprising: monitoring a first capacitive sensor having a first detection field that generates a first output signal upon detection of a user's hands in the first detection field; monitoring a second capacitive sensor having a second detection field that generates a second output signal upon detection of a user's hands in the second detection field; and toggling an electrically operable valve within the faucet between an opened position, in which water is free to flow through the faucet, and a closed position, in which the faucet is blocked and water flow through the faucet is inhibited, upon receipt of the first output signal but not the second output signal.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

Figure 1:
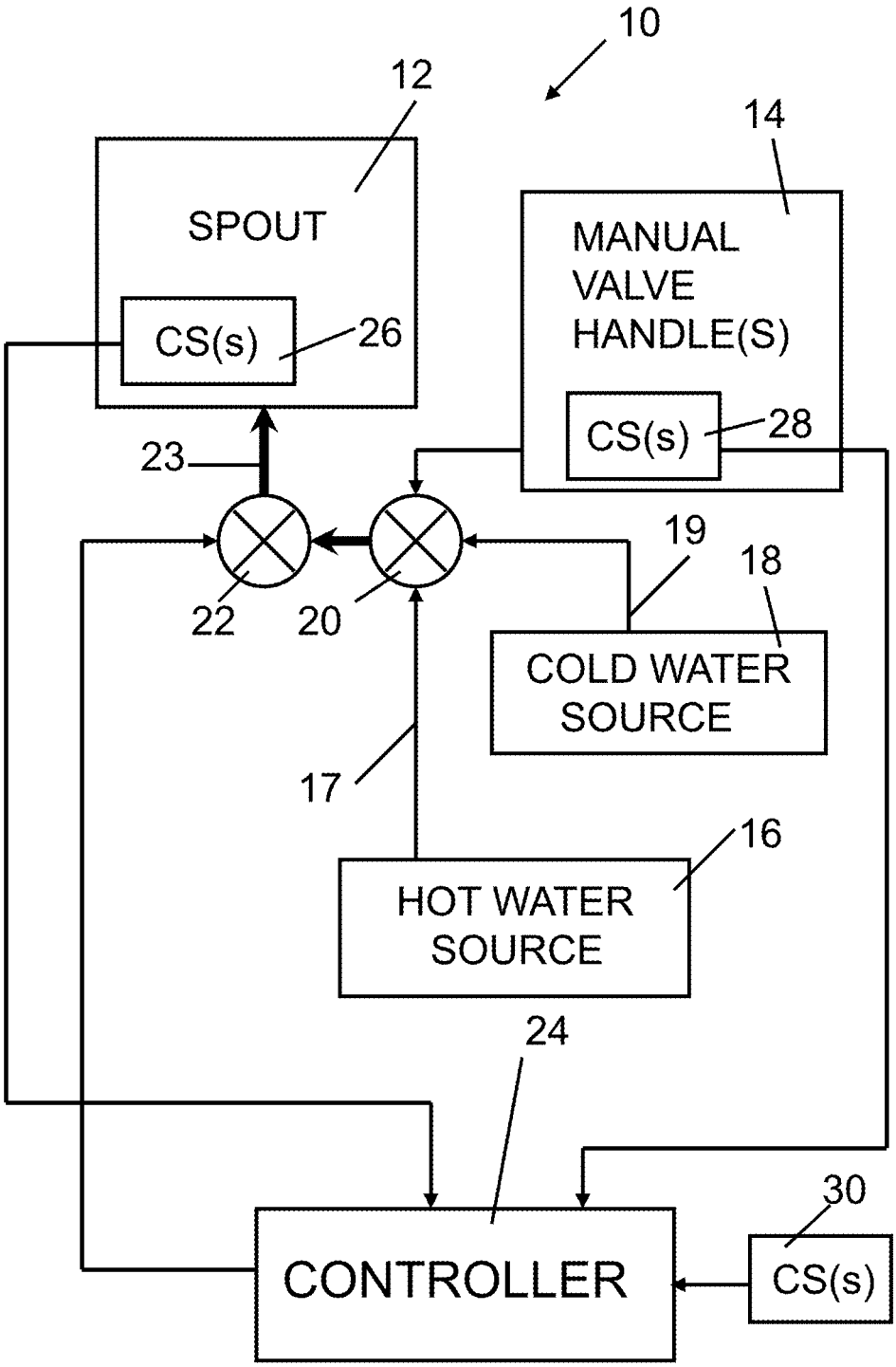
FIG. 1 is a block diagram of an illustrated embodiment of an electronic faucet.

For the purposes of promoting an understanding of the principles of the present disclosure, reference will now be made to the embodiments illustrated in the drawings, which are described below. The embodiments disclosed below are not intended to be exhaustive or limit the invention to the precise form disclosed in the following detailed description. Rather, the embodiments are chosen and described so that others skilled in the art may utilize their teachings. Therefore, no limitation of the scope of the claimed invention is thereby intended. The present invention includes any alterations and further modifications of the illustrated devices and described methods and further applications of the principles of the invention which would normally occur to one skilled in the art to which the invention relates.

FIG. 1 is a block diagram showing one illustrative embodiment of an electronic faucet 10 of the present disclosure. The faucet 10 illustratively includes a spout 12 for delivering fluids such as water and at least one manual valve handle 14 for controlling the flow of fluid through the spout 12 in a manual mode. A hot water source 16 and cold water source 18 are coupled to a manual valve body assembly 20 by fluid supply lines 17 and 19, respectively. The valve handle 14 is operably coupled to the manual valve body assembly 20 to control water flow therethrough.

In one illustrated embodiment, separate manual valve handles 14 are provided for the hot and cold water sources 16, 18. In other embodiments, such as a kitchen faucet embodiment, a single manual valve handle 14 is used for both hot and cold water delivery. In such kitchen faucet embodiment, the manual valve handle 14 and spout 12 are typically coupled to a basin through a single hole mount. An output of valve body assembly 20 is coupled to an actuator driven valve 22 which is controlled electronically by input signals received from a controller 24. In an illustrative embodiment, actuator driven valve 22 is an electrically operable valve, such as a solenoid valve. An output of actuator driven valve 22 supplies fluid to the spout 12 through supply line 23.

In an alternative embodiment, the hot water source 16 and cold water source 18 are connected directly to actuator driven valve 22 to provide a fully automatic faucet without any manual controls. In yet another embodiment, the controller 24 controls an electronic proportioning valve (not shown) to supply fluid to the spout 12 from hot and cold water sources 16, 18.

Because the actuator driven valve 22 is controlled electronically by controller 24, flow of water is controlled using outputs from sensors such as capacitive sensors 26, 28 and/or 30. As shown in FIG. 1, when the actuator driven valve 22 is open, the faucet 10 may be operated in a conventional manner, i.e., in a manual control mode through operation of the handle(s) 14 and the manual valve member of valve body assembly 20. Conversely, when the manually controlled valve body assembly 20 is set to select a water temperature and flow rate, the actuator driven valve 22 can be touch controlled, or activated by proximity sensors when an object (such as a user's hands) are within a detection zone to toggle water flow on and off.

In one illustrated embodiment, spout 12 has at least one capacitive sensor 26 connected to controller 24. In addition, the manual valve handle(s) 14 may also have capacitive sensor(s) 28 mounted thereon which are electrically coupled to controller 24. Additional capacitive sensors 30 may be located near the spout 12 of faucet 10, such as in an adjacent sink basin.

The output signals from capacitive sensors 26, 28 and/or 30 are used to control actuator driven valve 22 which thereby controls flow of water to the spout 12 from the hot and cold water sources 16 and 18. By sensing capacitance changes with capacitive sensors 26, 28, the controller 24 can make logical decisions to control different modes of operation of faucet 10 such as changing between a manual mode of operation and a hands free mode of operation as further described in U.S. Pat. Nos. 8,613,419; 7,690,395 and 7,150,293; and 7,997,301, the disclosures of which are all expressly incorporated herein by reference. Another illustrated configuration for a proximity detector and logical control for the faucet in response to the proximity detector is described in greater detail in U.S. Pat. No. 7,232,111, which is hereby incorporated by reference in its entirety.

The amount of fluid from hot water source 16 and cold water source 18 is determined based on one or more user inputs, such as desired fluid temperature, desired fluid flow rate, desired fluid volume, various task based inputs, various recognized presentments, and/or combinations thereof. As discussed above, the faucet 10 may also include an electronically controlled proportioning or mixing valve which is in fluid communication with both hot water source 16 and cold water source 18. Exemplary electronically controlled mixing valves are described in U.S. Pat. No. 7,458,520 and PCT International Publication No. WO 2007/082301, the disclosures of which are expressly incorporated by reference herein.

The present disclosure relates generally to faucets including hands free flow control and, more particularly, to a faucet including at least two capacitive sensors to detect a user's hands in a detection zone to control water flow. It is known to provide capacitive sensors on faucet components which create a detection zone near the faucet. When a user's hands are detected in the detection zone, the capacitive sensor signals a controller to turn on the flow of water to the faucet. See, for example, Masco's U.S. Pat. No. 8,127,782; U.S. Patent Application Publication No. 2010/0170570; or U.S. Patent Application Publication No. 2010/0108165.

Figure 2:
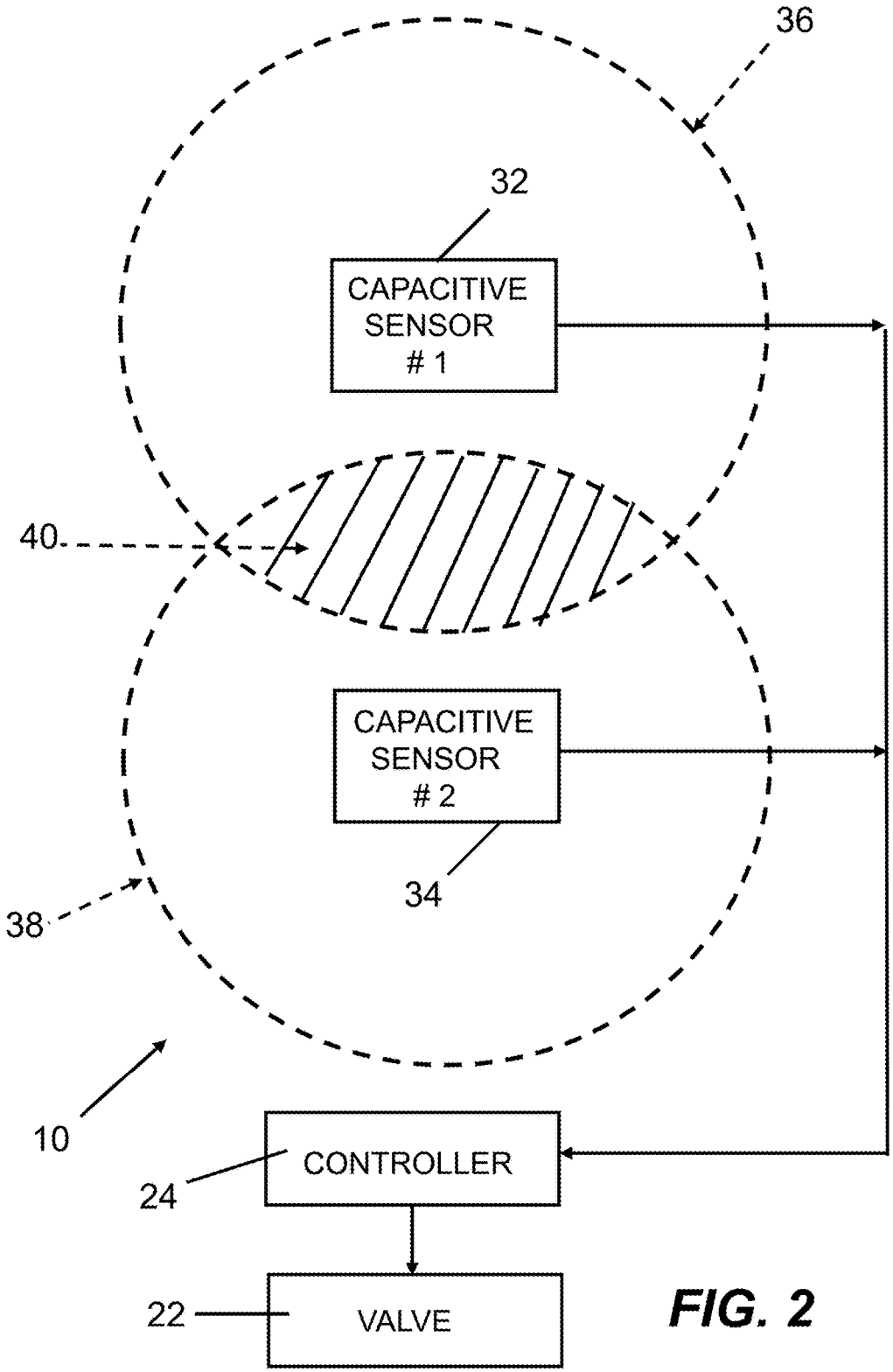
FIG. 2 is a block diagram illustrating an embodiment of the present disclosure including first and second capacitive sensors each having a separate detection field positioned to define an overlapping central detection region or detection zone, wherein a controller processes output signals from the first and second capacitive sensors to detect when a user is positioned within the detection zone.

FIG. 2 illustrates an embodiment of an electronic faucet system 10 of the present disclosure including a hands-free capacitive sensing system. The system 10 includes a controller 24 and first and second capacitive sensors 32 and 34 located on or near the faucet and coupled to the controller 24. The first capacitive sensor 32 has a generally spherical detection field 36 surrounding sensor 32, and the second capacitive sensor 34 has a generally spherical detection field 38 surrounding sensor 34. Capacitive sensors 32 and 34 detect objects, such as the user's hands, anywhere in the entire spherical detection regions 36 and 38, respectively. As shown in FIG. 2, detection field 36 overlaps detection field 38 in a generally prolate spheroid or "football" shaped region or detection zone 40. The controller 24 processes output signals from the first and second capacitive sensors 32 and 34 to detect when a user's hands are positioned within the detection zone 40. When the user's hands are detected in overlapping detection zone 40, controller 24 opens a valve 22 to provide fluid flow to an outlet of the faucet.

Figure 3:
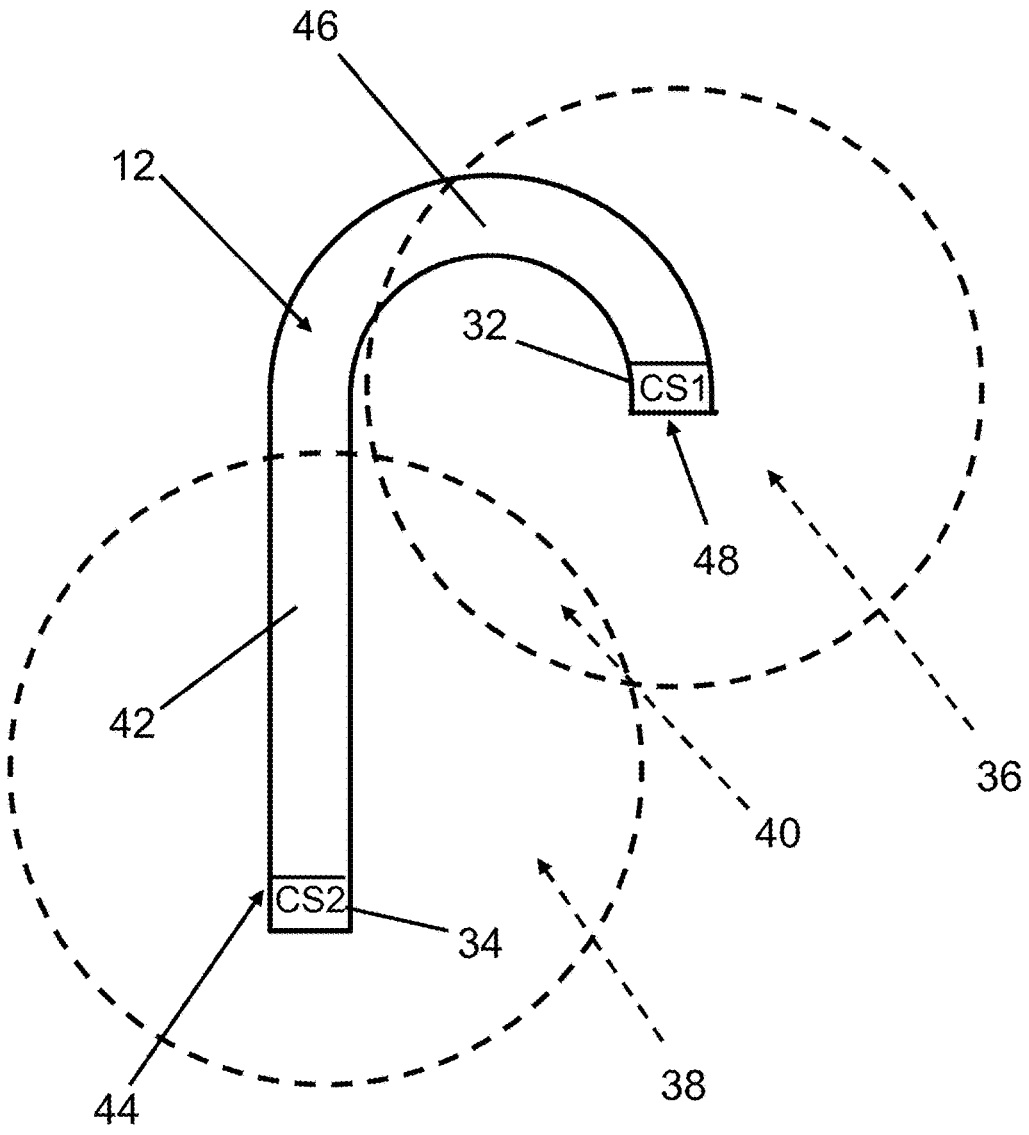
FIG. 3 is a block diagram illustrating the first and second capacitive sensors of FIG. 2 positioned on a spout of a faucet to define a detection zone adjacent the spout.

FIG. 3 illustrates the embodiment of FIG. 2 in which the capacitive sensors 32 and 34 are both coupled to a spout 12 of the faucet. Illustratively, the spout includes an upwardly extending portion 42 which is pivotably mounted to a hub 44 so that the spout 12 can swivel about an axis of the upwardly extending portion 42. Spout 12 further includes a curved portion 46 and an outlet 48 so that the spout 12 generally has an inverted J-shape.

Illustratively, the first capacitive sensor 32 is coupled to the spout 12 near outlet 48. The second capacitive sensor 34 is coupled to hub 44 or a lower section of upwardly extending portion 42 of spout 12. As discussed above, detection field 36 of capacitive sensor 32 and detection field 38 of capacitive sensor 34 overlap to define a detection zone 40. The first and second sensors 32 and 34 are positioned on the spout 12 so that the detection zone 40 is positioned at a desired location for detecting the user's hands. For instance, the detection zone 40 may be located near the outlet 48 of spout 12. In one embodiment, the detection zone 40 is beneath the curved portion 46 of spout 12 between the upwardly extending portion 42 and the outlet 48. Therefore, a user can turn the faucet on and off by placing the user's hand in the detection zone 40.

Figure 4:
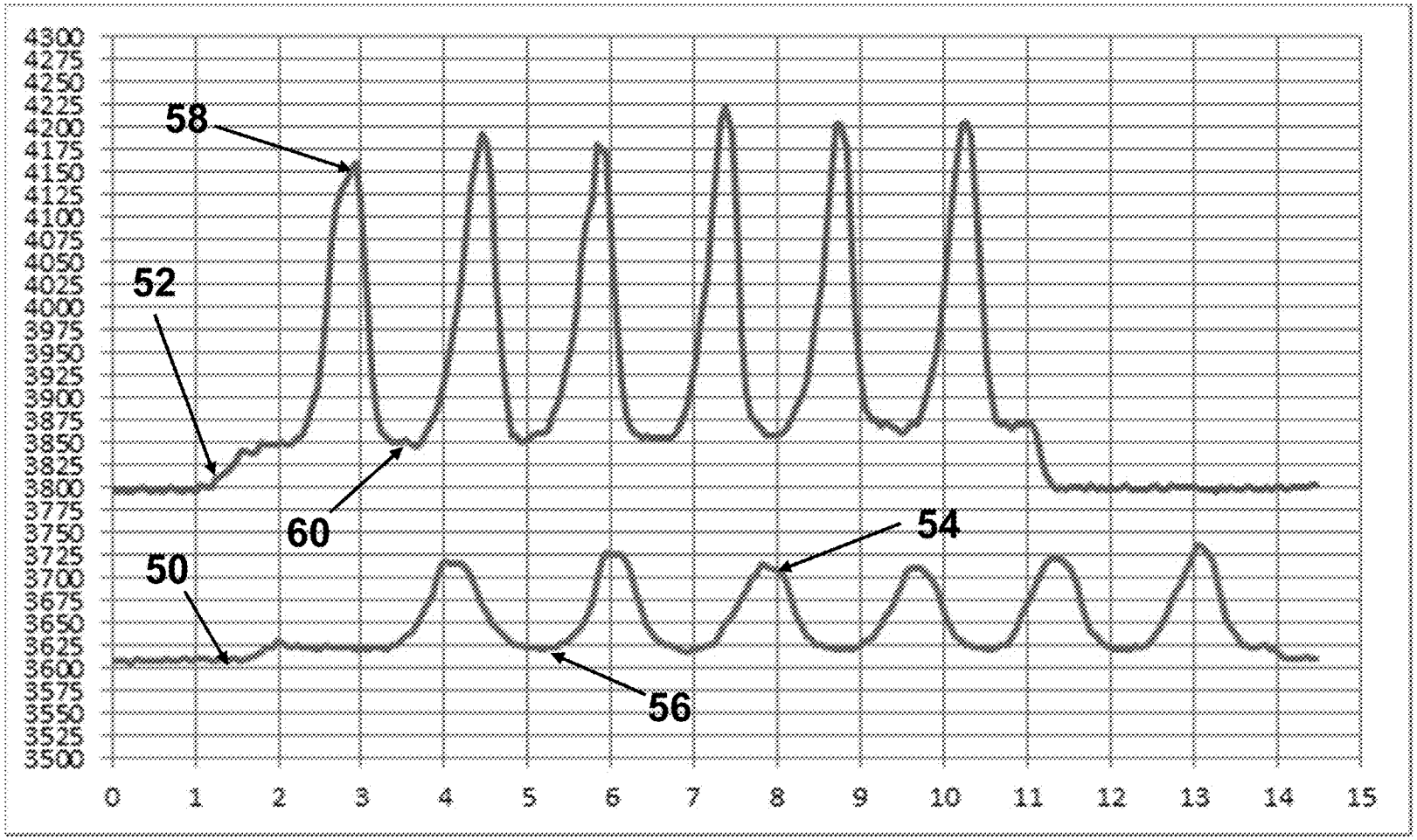
FIG. 4 illustrates exemplary output signals from the first and second capacitive sensors of FIGS. 2 and 3 as a user's hands move relative to the first and second capacitive sensors.

FIG. 4 illustrates output signals from the first and second capacitive sensors 32 and 34 of the embodiment shown in FIGS. 2 and 3 as a user's hands move back and forth between the first and second capacitive sensors 32 and 34. Illustratively, signal 50 is an output from the first capacitive sensor 32, and signal 52 is an output signal from the second capacitive sensor 34. Typically, the output signal 52 from the capacitive sensor 34 mounted on the hub 44 of spout 12 has a greater amplitude than the output signal 50 from the capacitive sensor 32 located near the outlet 48 of spout 12. The peaks 54 of output signal 50 indicate when the user's hands are approaching the first capacitive sensor 32 and the valleys 56 indicate when the user's hands are moving further away from capacitive sensor 32. The peaks 58 in output signal 52 illustrate when the user's hands are moving closer to the second capacitive sensor 34 on hub 44. The valleys 60 indicate when the user's hands have moved further away from the second capacitive sensor 34.

Controller 24 monitors the output signals 50 and 52 to determine when the user's hands are in the detection zone 40. For example, when both the amplitudes of output signals 50 and 52 are within preselected ranges defining the boundaries of the detection zone 40, the controller 24 determines that the user's hands are in the detection zone 40 and opens the valve 22 to begin fluid flow through the spout 12.

Controller 24 determines when the user's hands are in the detection zone 40 by looking at the signal strengths of the output signals 50 and 52 from capacitive sensors 32 and 34, respectively. The stronger the output signal, the closer the user's hands are to that sensor 32 or 34. For example, in FIG. 4 at time 3, the output signal 52 from the second capacitive sensor 34 is strong while the output signal 50 from the first capacitive sensor 32 is weak. This indicates that the user's hands are located closer to the second capacitive sensor 34. At time 8 in FIG. 4, the output signal 52 from the second capacitive sensor 34 is weak and the output signal 50 from the first capacitive sensor 32 is strong. This indicates that that the user's hands are located closer to the first capacitive sensor 32. At time 6 in FIG. 4, both output signals 50, 52 are strong. This indicates that the user's hands are located in the middle of detection zone 40.

Figure 5:
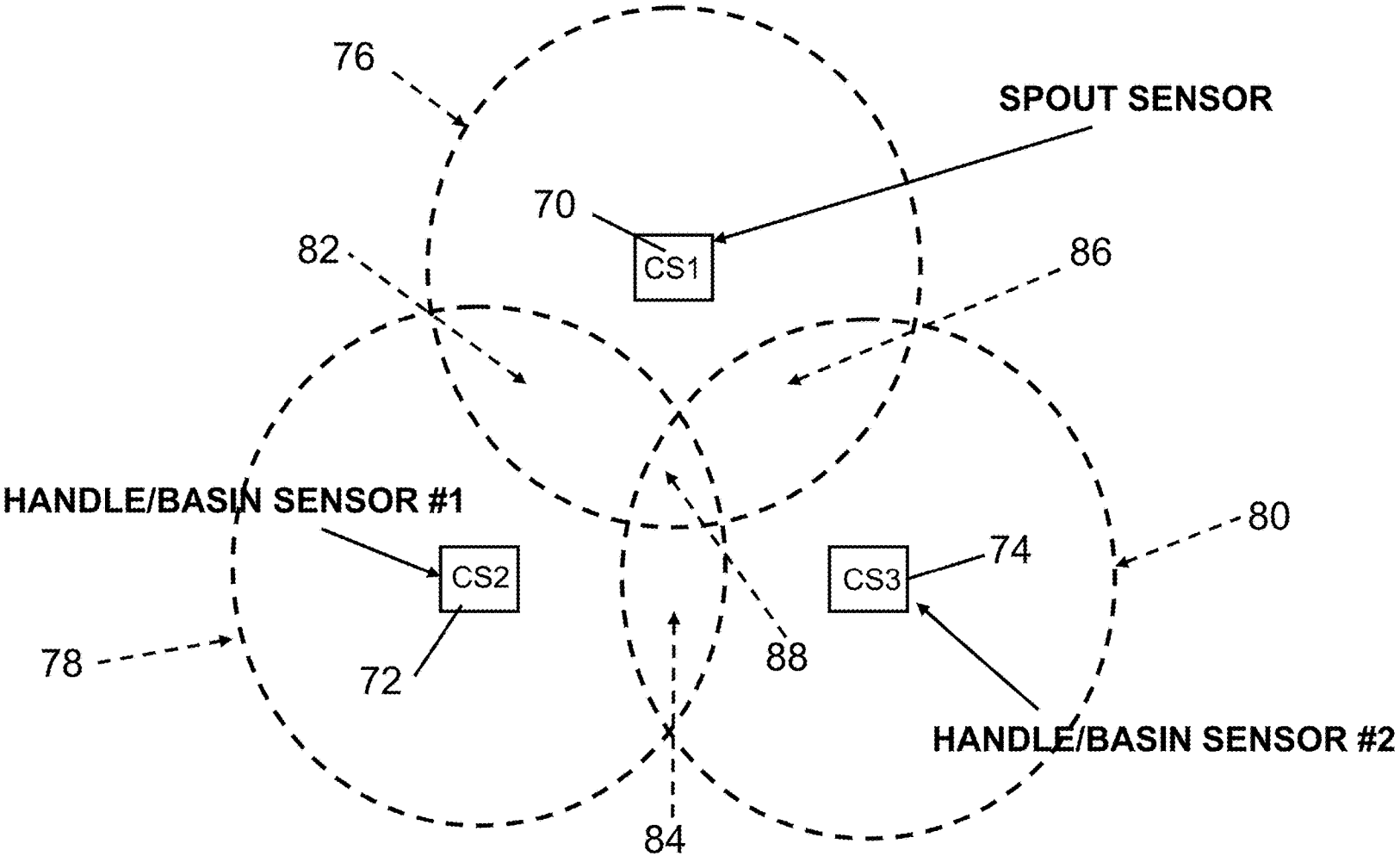
FIG. 5 is a block diagram illustrating another embodiment of the present disclosure including three capacitive sensors each having separate detection fields positioned to define a plurality of overlapping detection zones.

Another embodiment of the present disclosure is illustrated in FIG. 5. In this embodiment, first, second and third capacitive sensors 70, 72, and 74 are provided. Capacitive sensors 70, 72, and 74 each have separate detection fields 76, 78, and 80. In an illustrated embodiment, the first capacitive sensor 70 is mounted on a spout 12 of the faucet. The second and third capacitive sensors 72 and 74 are mounted on handles 14, a sink basin, or other location adjacent the spout 12.

In the FIG. 5 embodiment, detection fields 76 and 78 overlap within a detection zone 82. Detection fields 78 and 80 overlap within a detection zone 84. Detection fields 76 and 80 overlap within a detection zone 86. In addition, all three detection fields 76, 78 and 80 overlap within a central detection zone 88. By monitoring the outputs from capacitive sensors 70, 72 and 74, the controller 24 determines whether the user's hands are in one of the detection zones 82, 84, 86 or 88. The controller 24 controls the faucet differently depending on the detection zone 82, 84, 86 or 88 in which the user's hands are located. For example, the controller 24 may increase or decrease fluid flow, increase or decrease temperature, turn on or off fluid flow, or otherwise control the faucet or other components based upon which detection zone 82, 84, 86 or 88 the user's hands are located.

Figure 6:
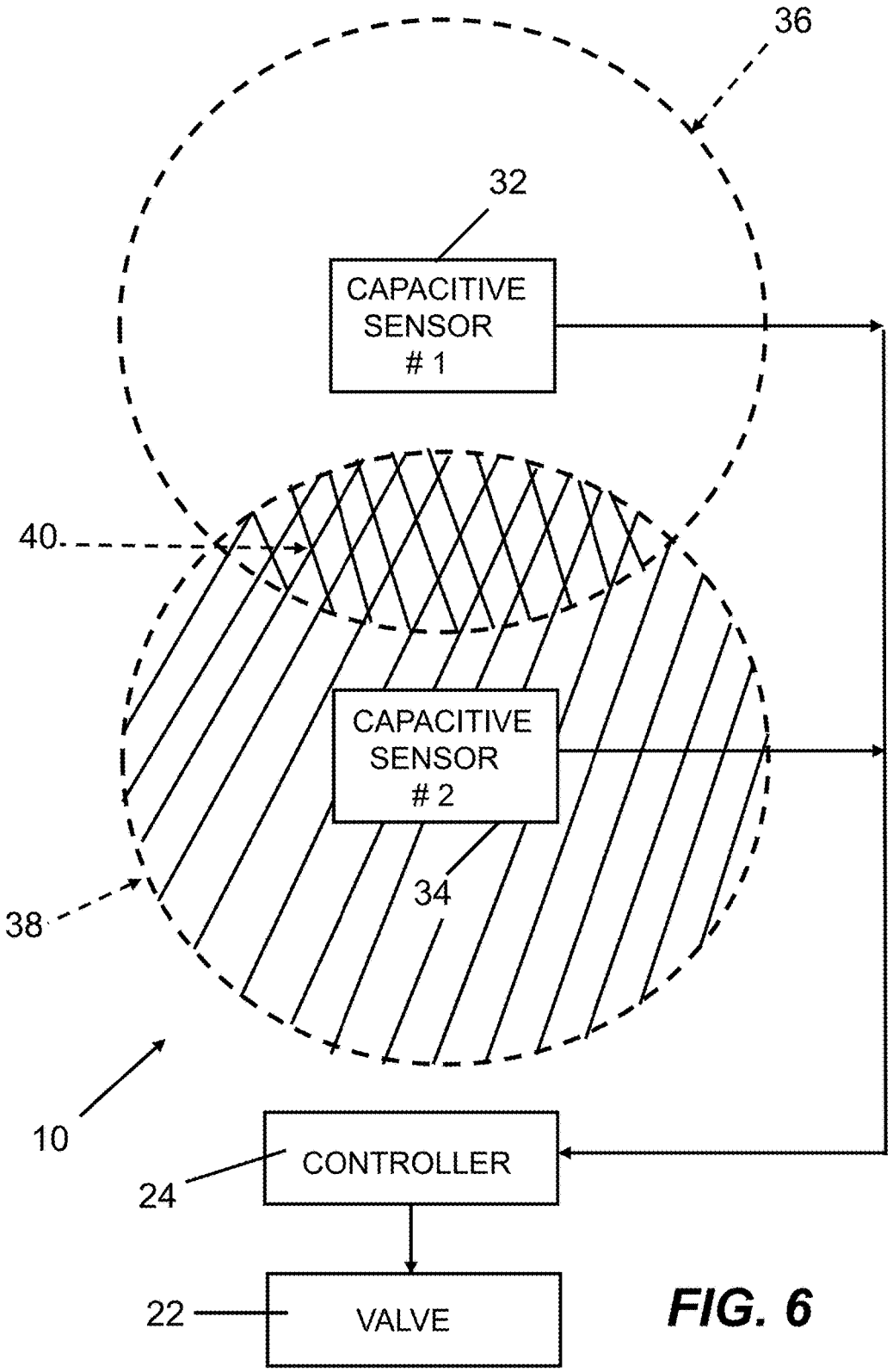
FIG. 6 is a block diagram illustrating another embodiment of the present disclosure including first and second capacitive sensors each having a separate detection field, wherein a controller processes output signals from the first and second capacitive sensors such that the second capacitive sensor acts as an inhibit to the first capacitive sensor.

Another embodiment of the present disclosure is illustrated in FIG. 6. In this embodiment, like the embodiment of FIG. 2, the system 10 illustratively includes a controller 24 and first and second capacitive sensors 32 and 34 located on or near the faucet 10 (FIG. 1) and coupled to the controller 24. The first capacitive sensor 32 has a general spherical detection field 36 surrounding sensor 32, and the second capacitive sensor 34 has a general spherical detection region 38 surrounding sensor 34. Capacitive sensors 32 and 34 detect objects, such as user's hands, anywhere in the spherical detection region 36 and 38, respectively. Detection field 36 overlaps detection field 38 in a generally prolate spheroid or "football" shaped region or detection zone 40.

The first capacitive sensor 32 and the related or associated detection region 36, not including the overlapping detection zone 40, defines an activation field. In contrast, the second capacitive sensor 34 and associated detection field 38, including the overlapping detection field 40, define an inhibit field. More particularly, detection of an object or user's hands, within the inhibit field (i.e., detection fields 38 and/or 40) will inhibit operation (e.g., activation or deactivation) of the valve 22 (FIG. 1). However, detection of an object or user's hands in the activation field (i.e., detection field 36), without detecting an object or user's hands within the inhibit field (i.e., detection fields 38 and/or 40) will operate valve 22, such as by toggling the valve 22 between open and closed positions. That is, valve 22 may be toggled from the open position to the closed position or vice-versa if detection of an object or user's hands in the activation field (i.e., detection field 36), without detecting an object or user's hands within the inhibit field (i.e., detection fields 38 and/or 40) occurs. It is also within the scope of the present disclosure that the overlapping detection field 40 may be considered part of the activation field 36 rather than part of the inhibit field 38.

Figure 8:
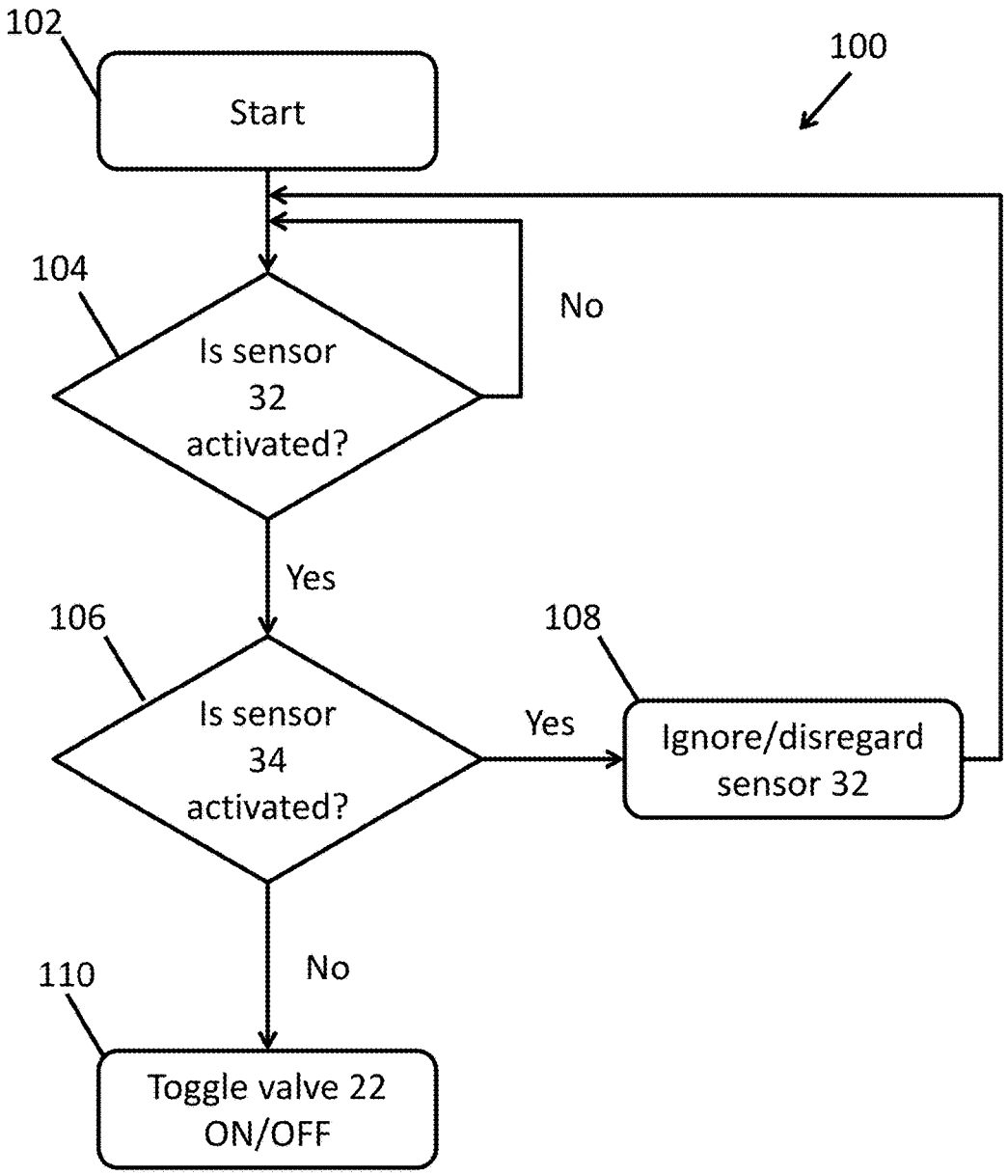
FIG. 8 is a flow chart illustrating operation of the embodiment of FIG. 6.

FIG. 8 illustrates the functionality of controller 24 of FIG. 6 with respect to capacitive sensors 32 and 34 by a method 100. At block 102, faucet 10 (FIG. 1) is activated such that controller 24 can toggle the state of valve 22 based on the signals transmitted by capacitive sensors 32 and 34. At block 104, controller 24 monitors capacitive sensor 32 to determine whether capacitive sensor 32 has transmitted a first output signal to controller 24. Capacitive sensor 32 transmits a first output signal to controller 24 when an object (e.g., a user's hand) is detected within detection field 36 for a specified period of time. In an exemplary embodiment, capacitive sensor 32 transmits a first output signal when the object is detected within detection field 36 for a time period between 60 milliseconds and 270 milliseconds (which is illustratively called a "swipe"). However, it is contemplated that other time periods may be used. If controller 24 receives a first output signal from capacitive sensor 32 in block 104, then controller 24 moves on to block 106 and determines whether a second output signal was received by capacitive sensor 34 based on whether an object or a user's hand was detected in detection fields 38 and/or 40 as discussed further herein. If controller 24 does not receive a first output signal from capacitive sensor 32 in block 104, then controller 24 continues to monitor the state of capacitive sensor 32.

At block 106, controller 24 monitors capacitive sensor 34 to determine whether a second output signal from capacitive sensor 34 has been transmitted to controller 24. Controller 24 monitors capacitive sensor 34 for a predetermined period of time surrounding (e.g., before and/or after) the reception of the first output signal from capacitive sensor 32 at block 104. In an exemplary embodiment, controller 24 monitors capacitive sensor 36 for no greater than 120 milliseconds to determine whether an object (e.g., a user's hand) is present within detection field 38 and/or 40. However, it is contemplated that other time ranges may be used. If controller 24 detects a second output signal from capacitive sensor 34 within the predetermined time period, controller 24 moves to block 108 and ignores the previous signal received from capacitive sensor 32 at block 104. As discussed above, ignoring capacitive sensor 32 may maintain (i.e., prevent toggling) the valve 22 in its current state (e.g., deactivate valve 22, and thereby inhibit liquid from exiting spout 12, or allow liquid to continue to exit from the spout 12 (FIG. 1)). Controller 24 then returns to monitor the status of capacitive sensor 32 at block 104. If, on the other hand, controller 24 does not detect a second output signal from capacitive sensor 34 in block 106 within the predetermined time period, controller 24 continues to block 110 and operates valve 22 normally, such as by toggling valve 22 between open and closed positions, where liquid is dispensed from spout 12 in the open position and dispensing of liquid is stopped in the closed position.

Figure 7:
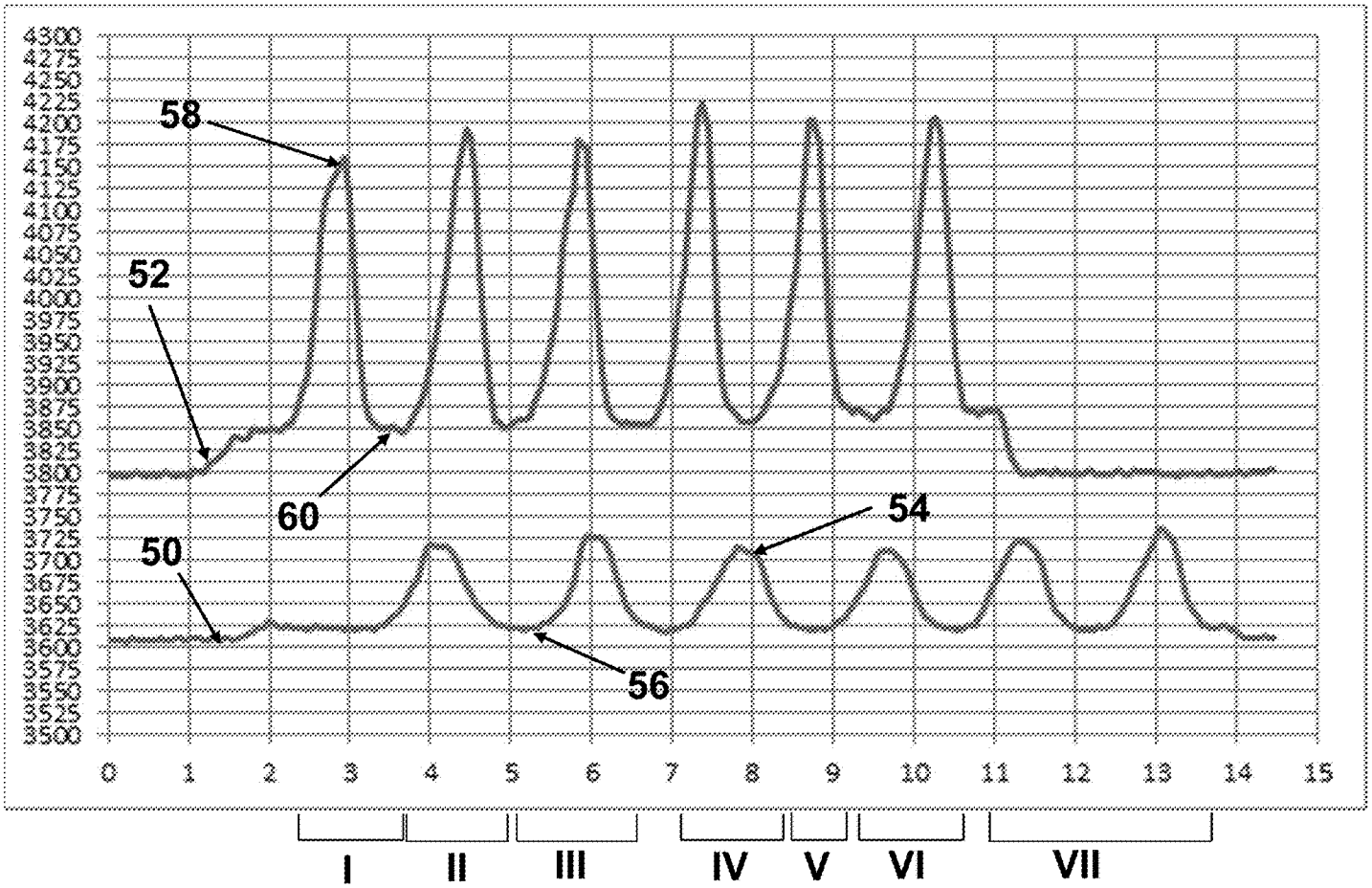
FIG. 7 illustrates exemplary output signals from the first and second capacitive sensors of FIG. 6 as a user's hands more relative to the first and second capacitive sensors.

FIG. 7 illustrates output signals from the first and second capacitive sensors 32 and 34 of the embodiment shown in FIG. 6 as a user's hands move back and forth between the first and second capacitive sensors 32 and 34. Illustratively, signal 52 is an output from the first capacitive sensor 32, and signal 50 is an output signal from the second capacitive sensor 34. Typically, the output signal 52 from the capacitive sensor 32 mounted on the hub 44 of spout 12 has a greater amplitude than the output signal 50 from the capacitive sensor 34 located near the outlet 48 of spout 12. The peaks 54 of output signal 50 indicate when the user's hands are approaching the first capacitive sensor 34 and the valleys 56 indicate when the user's hands are moving further away from capacitive sensor 34. The peaks 58 in output signal 52 illustrate when the user's hands are moving closer to the second capacitive sensor 32 on hub 44. The valleys 60 indicate when the user's hands have moved further away from the second capacitive sensor 34.

Controller 24 controls the behavior of spout 12 by monitoring output signals 50 and 52 to determine when the user's hands are in detection zone 36 and/or detection zones 38, 40, respectively. That is, controller 24 monitors the spatial relation between the signal strengths of output signals 52 and output signals 50. When controller 24 receives a peak from output signal 52 (e.g., peak 58) for capacitive sensor 32, controller 24 monitors a predetermined time interval surrounding the peak to determine whether liquid should be inhibited from flowing through spout 12 due to the presence of a peak from output signal 50 (e.g., peak 54) for capacitive sensor 34. When the peaks of output signals 52 are spaced from the peaks of output signals 50 for a time interval greater than the predetermined time interval set in block 106 discussed above, controller 24 may determine that the user's hands are in detection zone 36 and open valve 22 to begin fluid flow through the spout 12. Exemplary time periods with this configuration are shown as regions I and V.

When the peaks of output signals 52 are aligned with or spaced from the amplitude of output signals 50 at a time interval less than or equal to the predetermined time interval set in block 106 discussed above, controller 24 may illustratively determine that the user's hands are in the detection zone 38 and/or 40 and maintain valve 22 in the closed position if valve 22 is already in the closed position (and/or close valve 22 if open) to inhibit fluid flow through the spout 12. Exemplary time periods with this configuration are shown as regions II-IV and VI. With respect to regions II and VI, valve 22 is illustratively toggled to the closed position from the open position of regions I and V discussed previously.

In an alternate embodiment, capacitive sensors 32 and 34 may toggle valve 22 between the opened and closed positions. More particularly, the capacitive signals emitted by sensors 32 and 34 directly toggle valve 22 between the opened and closed positions depending on whether detection of an object or user's hands in the activation field (i.e., detection field 36), without detection of an object or user's hands within the inhibit field (i.e., detection fields 38 and/or 40) occurs, as previously discussed.

The exemplary time period shown as region VII can be ignored by controller 24 as there is no peak from output signal 52 from which to measure to determine whether valve 22 should be opened.

While this disclosure has been described as having exemplary designs and embodiments, the present invention may be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains. Therefore, although the invention has been described in detail with reference to certain illustrated embodiments, variations and modifications exist within the spirit and scope of the invention as described and defined in the following claims.

The invention claimed is:

1. A faucet comprising:

a spout;

a passageway that conducts water flow through the spout;

an electrically operable valve disposed within the passageway and having an opened position, in which water is free to flow through the passageway, and a closed position, in which the passageway is blocked;

a first capacitive sensor having a first detection field that generates a first output signal upon detection of a user's hands in the first detection field;

a second capacitive sensor having a second detection field that generates a second output signal upon detection of a user's hands in the second detection field;

an overlapping detection field defined by an overlap of the first detection field and the second detection field;

an activation field defined by the first detection field less the overlapping detection field;

an inhibit field defined by the second detection field including the overlapping detection field; and a controller coupled to the first and second capacitive sensors and the electrically operable valve, the controller being programmed to actuate the electrically operable valve in response to detecting the user's hands in the activation field, and the controller being programmed to inhibit operation of the electrically operable valve in response to detecting the user's hands in the inhibit field.

2. The faucet of claim 1, wherein the spout includes an upwardly extending portion pivotably mounted to a hub so that the spout swivels about an axis of the upwardly extending portion, the spout further includes a curved portion and an outlet, the first capacitive sensor being coupled to the spout adjacent the outlet and the second capacitive sensor being coupled to the hub to define the first detection field near the outlet of the spout.

3. The faucet of claim 2, wherein the first detection field is beneath the curved portion of spout between the upwardly extending portion of the spout and the outlet.

4. The faucet of claim 1, further comprising a manual valve disposed within the passageway in series with the electrically operable valve, and a manual handle that controls the manual valve.

5. The faucet of claim 4, wherein the first capacitive sensor is coupled to the spout and the second capacitive sensor is coupled to the manual handle.

6. The faucet of claim 1, wherein the second detection field overlaps the first detection field in a manner that reduces the size of the first detection field.

7. A faucet comprising:

a spout;

a passageway that conducts water flow through the spout;

an electrically operable valve disposed within the passageway and having an opened position, in which water is free to flow through the passageway, and a closed position, in which the passageway is blocked;

a first capacitive sensor having a first detection field that generates a first output signal upon detection of a user's hands in the first detection field;

a second capacitive sensor having a second detection field that generates a second output signal upon detection of a user's hands in the second detection field;

a controller coupled to the first and second capacitive sensors and the electrically operable valve, the controller being programmed to actuate the electrically operable valve in response to detecting the user's hands in the first detection field but not in the second detection field; and wherein the controller inhibits the electrically operable valve from moving to the opened position when the user's hands are detected within the first detection field and the second detection field.

8. The faucet of claim 7, wherein the spout includes an upwardly extending portion mounted to a hub, the spout further includes a curved portion and an outlet, the first capacitive sensor being coupled to the spout adjacent the outlet and the second capacitive sensor being coupled to the hub to define the first detection field near the outlet of the spout.

9. The faucet of claim 8, wherein the first detection field is beneath the curved portion of spout between the upwardly extending portion of the spout and the outlet.

10. The faucet of claim 8, wherein the spout is pivotably mounted to the hub, so that the spout swivels about an axis of the upwardly extending portion.

11. The faucet of claim 7, further comprising a manual valve disposed within the passageway in series with the electrically operable valve, and a manual handle that controls the manual valve.

12. The faucet of claim 11, wherein the first capacitive sensor is coupled to the spout and the second capacitive sensor is coupled to the manual handle.

13. A faucet comprising:

a spout;

a passageway that conducts water flow through the spout;

an electrically operable valve disposed within the passageway and having an opened position, in which water is free to flow through the passageway, and a closed position, in which the passageway is blocked;

a first capacitive sensor having a first detection field that generates a first output signal upon detection of a user's hands in the first detection field;

a second capacitive sensor having a second detection field that generates a second output signal upon detection of a user's hands in the second detection field;

a controller coupled to the first and second capacitive sensors and the electrically operable valve, the controller being programmed to actuate the electrically operable valve in response to detecting the user's hands in the first detection field but not in the second detection field; and wherein the controller inhibits the electrically operable valve from moving to the opened position when the user's hands are detected within the second detection field within a predetermined time surrounding the detection of the user's hands in the first detection field.

14. The faucet of claim 13, wherein the spout includes an upwardly extending portion mounted to a hub, the spout further includes a curved portion and an outlet, the first capacitive sensor being coupled to the spout adjacent the outlet and the second capacitive sensor being coupled to the hub to define the first detection field near the outlet of the spout.

15. The faucet of claim 14, wherein the first detection field is beneath the curved portion of spout between the upwardly extending portion of the spout and the outlet.

16. The faucet of claim 14, wherein the spout is pivotably mounted to the hub, so that the spout swivels about an axis of the upwardly extending portion.

17. The faucet of claim 13, further comprising a manual valve disposed within the passageway in series with the electrically operable valve, and a manual handle that controls the manual valve.

18. The faucet of claim 17, wherein the first capacitive sensor is coupled to the spout and the second capacitive sensor is coupled to the manual handle.

19. A method of actuating a faucet comprising:

monitoring a first capacitive sensor having a first detection field that generates a first output signal upon detection of a user's hands in the first detection field;

monitoring a second capacitive sensor having a second detection field that generates a second output signal upon detection of a user's hands in the second detection field;

toggling an electrically operable valve within the faucet between an opened position, in which water is free to flow through the faucet, and a closed position, in which the faucet is blocked and water flow through the faucet is inhibited, upon receipt of the first output signal but not the second output signal;

inhibiting the first output signal from the first capacitive signal when the second output signal is generated from the second capacitive sensor; and returning to the monitoring the first capacitive sensor.

20. The method of claim 19, wherein monitoring the second capacitive sensor is performed when the first output signal from the first capacitive sensor is generated.

21. The method of claim 19, further comprising:

providing a spout including a hub, a curved portion supported by the hub, and an outlet;

coupling the first capacitive sensor to the spout adjacent the outlet; and coupling the second capacitive sensor to the hub.

* * * * *